United States Patent [19]

Bunn

[11] Patent Number: 4,548,565

[45] Date of Patent: Oct. 22, 1985

[54] EXTRUSION MACHINE

[75] Inventor: Christopher B. Bunn, North Vancouver, Canada

[73] Assignee: DY-Core Systems Ireland Limited, Dublin, Ireland

[21] Appl. No.: 614,395

[22] Filed: May 25, 1984

Related U.S. Application Data

[63] Continuation of Ser. No. 323,648, Nov. 20, 1981, abandoned.

[51] Int. Cl.[4] ..... B28B 1/08; B28B 3/22

[52] U.S. Cl. ..... 425/64; 425/380; 425/447; 425/456; 425/467

[58] Field of Search ..... 425/113, 131.4, 134, 425/427, 62–64, 111, 447, 456, 466, 467, 380

[56] References Cited

U.S. PATENT DOCUMENTS

| | | | |
|---|---|---|---|
| 2,230,309 | 2/1941 | Reed | 264/177 R |
| 3,877,860 | 4/1975 | Putti | 425/64 |
| 3,904,341 | 9/1975 | Putti | 425/64 |
| 4,022,555 | 5/1977 | Goetjen | 425/64 |
| 4,067,676 | 1/1978 | Hewitt | 425/64 |
| 4,133,619 | 1/1979 | Wise | 425/64 |
| 4,273,522 | 6/1981 | Bunn | 425/113 |

*Primary Examiner*—Willard E. Hoag
*Attorney, Agent, or Firm*—Townsend and Townsend

[57] ABSTRACT

An extrusion machine for making elongated articles of concrete by forcing the concrete through a mold, the article having a relatively large core. The machine is moved forwardly by reaction as the concrete is forced against the molded concrete. A rotatable spiral conveyor extends longitudinally of the mold and moves the concrete through the mold. A nonrotatable forming element in the mold forms the internal cavity. The element is immediately following the downstream end of the conveyor. The forming element has its lower edge positioned so that not more than 10% of the height of the forming element is below the lower edge of the conveyor the lower edge and lower sides of the element being free of any substantial ramp. The longitudinal center line of the element is higher than the center line of the conveyor and includes a ramp extending upwardly from the downstream end of the conveyor. The conveyor forces the concrete over the forming elements to form the concrete article.

8 Claims, 4 Drawing Figures

EXTRUSION MACHINE

This is a continuation Ser. No. 323,648, filed Nov. 20, 1981, now abandoned.

FIELD OF THE INVENTION

This invention relates to an extrusion machine for making elongated articles of concrete.

DESCRIPTION OF THE PRIOR ART

The extruding of concrete through a mold, usually by the use of a screw conveyor to force the concrete through the mold, is well known. U.S. Pat. No. 3,159,897 issued Dec. 8th, 1964 to Ellis discloses a machine having a plurality of spiral conveyors or augers each with a flight fixed to a core shaft. Each auger has a trowelling mandrel secured to the downstream end and that mandrel rotates with the auger. A vibrator is mounted on the machine outside the molding area so that the entire machine is vibrated. In the Ellis machine the trowelling unit is fixed to an auger and rotates with it and the machine thus forms concrete slabs in which the cores must be of circular cross section.

Our Canadian Pat. No. 910,030 issued Sept. 19th, 1972 describes an extrusion machine having a forming element of any cross sectional shape. In the extrusion machine of Canadian Pat. No. 910,030 there is a forming element of any cross sectional shape independent of and immediately following the downstream end of the spiral conveyor. That forming element is mounted so as not to be rotated by the conveyor. It may be nonrotated or it may be rotated at a speed different from the conveyor or indeed at a speed the same as the conveyor but the feature of the patent is that the spiral conveyor and the forming element can be driven independently.

Our Canadian Pat. No. 1,031,934 issued May 30th, 1978 shows a machine for extruding elongate articles of concrete in which a fixed transverse plate is positioned across the upstream end of the mold and in which the conventional screw conveyor is used to force the concrete towards the mold. The invention of this patent is directed to formation of concrete bodies having cores of different sizes. In this patent the molding elements do not rotate.

Our Canadian Pat. No. 1,100,297 issued May 5th, 1981 shows an extrusion machine of a generally similar type but including a support tube so that reinforcing members may be introduced into the formed article. However, again the patent generally discloses a machine having a molding section with a forming element in it and in which concrete is forced through the mold by a screw conveyor.

The above machines generally move along a track on wheels and extrude the formed concrete body on the upper surface of the track. This is possible because the concrete is a relatively stiff mix and, of course, modern technology permits rapid setting of concrete.

The above machines have proved useful but, especially at present, it is important to seek ways in which the minimum amount of concrete is used to produce a body of adequate strength. In this regard all the prior art machines could possibly be said to be inadequate because the structure of the machines has not allowed the production of concrete bodies in which the cores are above a certain percentage of the cross sectional area. A relatively large core cross section would in fact be perfectly acceptable in producing a body of adequate strength but the machines available are not able to produce such bodies. It would for example, be desirable in certain circumstances, to produce bodies in which the core is relatively deep, but in which the outer walls provide sufficient material to meet the structural requirement, but considerable problems have been encountered in attempting to produce such bodies.

SUMMARY OF THE INVENTION

The present invention seeks to provide a machine in which an optimum cross section of a hollow concrete body can be produced, that is the minimum amount of concrete can be used to produce a body of the required strength.

Accordingly, the present invention is an extrusion machine for making elongated articles of concrete by forcing the concrete through a mold, the article having a relatively large cavity and using the optimum amount of concrete for required strength, the machine being moved forwardly by reaction as the concrete is forced against the molded concrete. A rotatable spiral conveyor located in and extending longitudinally of the mold, moves the concrete through the mold; a nonrotatable forming element in the mold form the internal cavity immediately following the downstream end of the conveyor. The forming element has (a) its lower edge positioned so that not more than 10% of the height of the forming element is below the lower edge of the conveyor, said lower edge and lower sides being free of any substantial ramp, (b) its longitudinal center line higher than the center line of the conveyor and (c) a ramp extending upwardly from the downstream end of the conveyor. The conveyor forces the concrete over the forming elements to form the concrete article.

It is extremely desirable that there be a vibrator within the forming element. It is also useful, on occasions, to include vibrator plate on top of the mold, above the forming element.

The forming element should be free of any substantial ramp at its bottom upstream edge and sides. However, a ramp is permissible provided it is short. Its length must not exceed 25% of the length of the forming element.

As is common with machines as discussed in the prior art it is desirable that there be a plurality of forming elements. The first element is formed with a vibrator and the subsequent elements are unvibrated. There is thus a damper means between each forming element.

BRIEF DESCRIPTION OF THE DRAWINGS

Aspects of the invention are illustrated, merely by way of example, in the drawings in which.

DESCRIPTION OF THE PREFERRED EMBODIMENTS

Figure 1:
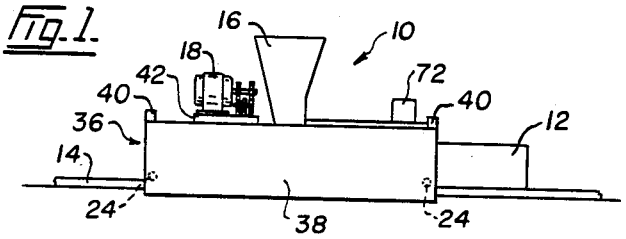
FIG. 1 is a general view of a machine according to the present invention.

FIG. 1 illustrates an extrusion machine 10 showing a block 12 extruded from the machine onto a base and track 14. There is a hopper 16 through which the concrete is fed to the machine 10 and an electric motor 18 to turn the screw conveyors 20 and 22 shown in more detail in FIGS. 2 and 3. The machine 10 has wheels 24 to move along the upper surface of the track 14.

Figure 2:
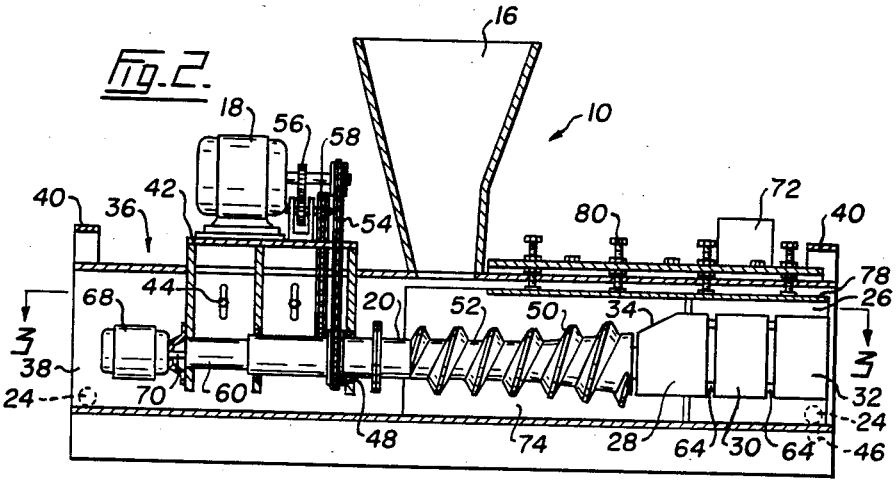
FIG. 2 is a section through a machine according to the present invention.
Figure 3:
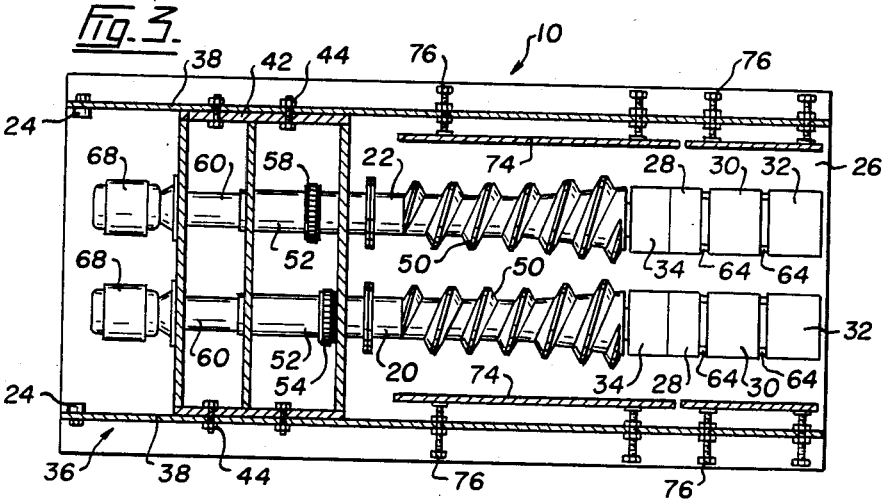
FIG. 3 is a section along the line 3—3 in FIG. 2.
Figure 4:
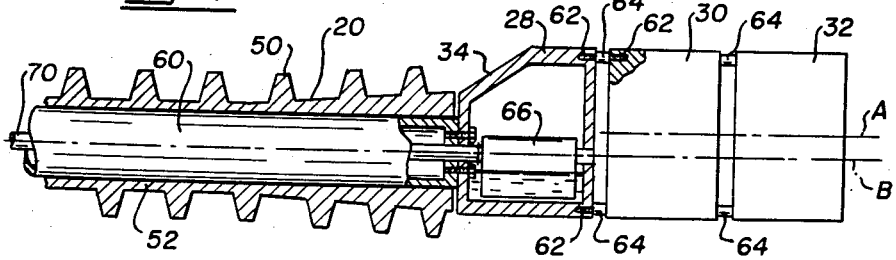
FIG. 4 is a detail of the machine illustrated in FIGS. 2 and 3.

FIG. 2 illustrates the machine in more detail. Rotatable spiral conveyors 20 and 22 extend longitudinally of a mold 26. Concrete is fed through the hopper 16 and the machine 10 moves forward as the conveyors force concrete against the already formed article. An internal cavity is formed in the extruded article. In the illustrated embodiment the internal cavity has a depth, defined by its position at formation, greater than its width but this is not essential. The invention, in effect, produces articles with relatively large cores compared with the prior art. The cores may be large by extending upwardly or laterally to an extent not possible in prior art machines. This is achieved in the present invention by the provision of forming elements 28, 30 and 32 each having its lower edge in line with a lower edge of the conveyor as illustrated particularly in FIG. 2. However, it should be noted that the same results can be achieved if the forming element lower edge is below the lower edge of the conveyor provided that not more than 10% of the total height of the forming element is below the lower edge of the conveyor. The longitudinal center line A of the elements is higher than the center line B of the conveyor, as particularly illustrated in FIG. 4, and a ramp 34 as shown in FIGS. 2 and 4, extends upwardly from the downstream end of the conveyors 20 and 22 that is adjacent the end of the conveyor, within the mold 26.

The machine has, as may be considered conventional, a main frame 36 having side members 38 and cross members 40. There is a mounting frame 42 mounted on the side members 38 which extends across the machine. This mounting frame 42 can be adjusted up and down by the provision of bolts 44. The main frame 36 is provided with wheels 24 that ride on the rails 14 but it is also necessary to prevent the downstream end of the machine from rising during operation. Wheels 46 engage the undersurface of the sides 38 as shown in FIG. 2 to prevent any possible lifting of the machine. Weights added to the downstream end of the machine can be used instead. There are shown two spiral conveyors 20 and 22 although the skilled man will know that wide variation of that number is possible. Each is mounted at one end in suitable bearings 48 carried by mounting frame 42. Each conveyor is made of a flight 50 secured to or formed integrally with a hollow shaft 52. As particularly shown in FIG. 4 the hollow shaft 52 has a straight section extending part of the length of the conveyor but the section increases outwardly towards the downstream end. However, it may be of uniform cross section.

Conveyor 20 is rotated in its bearing 48 by a chain and sprocket arrangement 54 driven by electric motor 18 mounted on frame 42. The second conveyor 22 may be provided with a separate electric motor but is desirably driven by the same electric motor 18 through gears 56 and a chain and sprocket arrangement 58 ensuring that the two conveyors 20 and 22 rotate in opposite directions.

The forming elements 28, 30 and 32 are each mounted on a shaft 60 extending through the hollow core shaft 52. The first element 28, with ramp 34 is attached to the end of the internal shaft. The remaining elements 30 and 32 are then bolted successively first to the ramped element 28 by bolts 62 which also engage in dampers 64. This is because the first element 28 is provided with a vibrator 66, driven by electric motor 68 through internal shaft 70. The vibrator, which is a simple eccentric, will not be described here further as it is well known in the art. It should also be noted that an additional vibrator 72 may be provided on top of the machine as shown in FIG. 2. The structure of this vibrator 72 will also not be described as it is conventional.

Again as is conventional the width of the body 12 to be produced may be controlled by side plates 74 mounted on opposite sides of the mold 26. The side plates 74 are mounted for adjustment on frame members 38 by bolts 76. Similarly the depth of the mold 26 can be controlled by upper plate 78 positioned on top of the molding section and adjustable on bolts 80 in conventional manner.

As previously indicated the position of the forming elements in the mold can be controlled by bolts 44.

In operation concrete is fed through the hopper 16 to the spiral conveyors 20 and 22. The concrete is forced over the forming elements 28, 30 and 32 in the mold 26 by the screw conveyor. The machine is moved forward by the reaction of the still fluid concrete against the formed surfaces within the mold element and the machine then moves on wheels 24 and deposits the formed elements 12 as shown in FIG. 1. Because of the concrete used the product sets up extremely quickly and is self-supporting virtually immediately upon formation. The vibrator 66 in the first forming element 28 ensures that the concrete flows smoothly around the forming elements.

The particular virtue of the present invention is that articles having relatively large cores and, for example, cores that are of substantial depth relative to the depth of the article, can be produced. This is made possible by the having the center line B of the screw lower than the center line A of the mold, by the provision of the ramp 34 on the top of the first forming element 28 and by the absence of any substantial ramp on the underside of the forming element. It is also desirable that there not be a ramp on the lower corners or sides of the forming element below the longitudinal axis of the screw as shown in FIG. 4. However, a small ramp is permitted here provided that it is not of great length or depth and does not exceed 25% of the forming element length.

The present invention thus permits the economical production of concrete bodies having the same strength as bodies produced on prior art machines but using less concrete.

I claim:

1. An extrusion machine for making elongated articles of concrete by forcing the concrete through a mold, the article having a relatively large core, the machine being moved forwardly by reaction as the concrete is forced against the molded concrete, a rotatable spiral conveyor in and extending longitudinally of the mold for moving the concrete through the mold;

a non-rotatable forming element in the mold to form the internal cavity immediately following the downstream end of the conveyor, the forming element having (a) a lower edge positioned so that not more than 10% of the height of the forming element is below the lower edge of the conveyor, the lower edge and lower sides of the element being free of any substantial ramp;

(b) a longitudinal center line higher than the center line of the conveyor; and (c) a ramp extending upwardly from the downstream end of the conveyor;

the conveyor forcing the concrete over the forming elements to form the concrete article.

2. A machine as claimed in claim 1 including a vibrator within the forming element.

3. A machine as claimed in claim 2 also including a vibrator plate on top of the mold, above the forming element.

4. A machine as claimed in claim 1 in which any ramp present at the bottom upstream edge of the forming element is short and does not exceed 25% of the forming element length.

5. A machine as claimed in claim 2 in which there are a plurality of forming elements, the first element formed with the vibrator, the subsequent elements being unvibrated and with vibration damper means between each forming element.

6. A machine as claimed in claim 1 in which the forming element is removable.

7. A machine as claimed in claim 5 in which the vibration damper means is a rubber disc between and secured to adjacent forming elements.

8. A machine as claimed in claim 1 including a plurality of screw conveyors and a plurality of forming elements so that the machine is able to form wide, relatively flat articles.

* * * * *